US005183319A

United States Patent [19]

Pearson et al.

[11] Patent Number: 5,183,319

[45] Date of Patent: Feb. 2, 1993

[54] ADJUSTABLE SUPPORT FOR OVERHEAD FURNITURE UNITS

[75] Inventors: Alan L. Pearson, Ionia; Richard H. Baker, Grand Rapids, both of Mich.

[73] Assignee: Steelcase, Inc., Grand Rapids, Mich.

[21] Appl. No.: 839,126

[22] Filed: Feb. 20, 1992

[51] Int. Cl.[5] ..... A47B 17/00

[52] U.S. Cl. ..... 312/196; 312/198; 248/188.4; 248/242

[58] Field of Search ..... 248/188.4, 242; 312/198, 203, 196; 108/111, 101, 98

[56] References Cited

U.S. PATENT DOCUMENTS

| | | | |
|---|---|---|---|
| 2,450,337 | 9/1945 | Hearst . | |
| 2,574,038 | 11/1951 | Howard | 2248/242 |
| 3,226,172 | 12/1965 | Bateman . | |
| 3,920,299 | 11/1975 | Propst et al. . | |
| 3,950,049 | 4/1976 | Drass . | |
| 3,953,093 | 4/1976 | Hero . | |
| 4,141,612 | 2/1979 | Rowe . | |
| 4,580,853 | 4/1986 | Hitzeroth et al. . | |
| 4,586,759 | 5/1986 | Wrobel . | |
| 4,635,615 | 1/1987 | Itoh et al. . | |
| 4,699,067 | 10/1987 | Okopny | 108/111 |
| 5,092,253 | 3/1992 | Grund et al. | 108/101 |

OTHER PUBLICATIONS

Brochure; Steelcase Part No. 93-9501505-K.

*Primary Examiner*—Kenneth J. Dorner
*Assistant Examiner*—Gerald A. Anderson
*Attorney, Agent, or Firm*—Price, Heneveld, Cooper, DeWitt & Litton

[57] ABSTRACT

A system for leveling and securing an overhead cabinet to modular furniture including a pair of spaced posts, each post including a lower end adapted to connect to the modular furniture and an upper end adapted to connect to the overhead cabinet, the upper ends each including a pair of leveling screws so that the overhead cabinet can be both leveled and aligned with adjacent overhead cabinets.

15 Claims, 5 Drawing Sheets

ADJUSTABLE SUPPORT FOR OVERHEAD FURNITURE UNITS

BACKGROUND OF THE INVENTION

The present invention relates to furniture, and in particular to an adjustable support for attaching overhead units to furniture articles, and the like.

It is known to attach overhead units to modular furniture. For example, in commonly assigned U.S. Pat. No. 5,092,253 to Grund issued Mar. 3, 1992 entitled MODULAR FURNITURE (Ser. No. 07/307,775, filed Feb. 7, 1989), an overhead cabinet is mounted to a workstation in a cantilever fashion by two upstanding posts. However, though overhead units are convenient in that they permit customization and on-site assembly, many overhead units require a significant amount of setup time to adequately level and "square" the units, and also align the units with adjacent furniture units. Thus, improvements are desired to facilitate the on-site assembly. For example, it is desired to provide overhead units that can be interconnected with a minimum amount of labor by a single assembler. Further, it is desired to provide an arrangement permitting horizontal and vertical adjustment of the overhead unit so that adjacent furniture units can be satisfactorily aligned.

SUMMARY OF THE INVENTION

The present invention includes an arrangement for leveling and securing an overhead unit to a modular furniture base unit. The invention is embodied in a modular furniture unit including a base unit, an elongate upstanding post including a lower end engaging the base unit so that the post extends generally vertically and further including an upper end having a laterally extending bracket, and an overhead modular unit including a lower portion engaging the laterally extending bracket. Leveling means located on the laterally extending bracket facilitates adjusting the spacial orientation of the overhead modular unit. The modular furniture unit also includes attaching means for securely attaching the overhead modular unit to the upstanding post, whereby the overhead modular unit can be placed on the upstanding post, leveled, and secured to same without manipulating the upstanding post on the modular furniture unit.

The present invention offers several advantages over known systems. The preferred embodiment allows a single operator to align and secure adjacent overhead units efficiently and with minimal or no assistance. Also, the interconnection is secure and readily made. Further, the arrangement is adaptable to various overhead units.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 3:
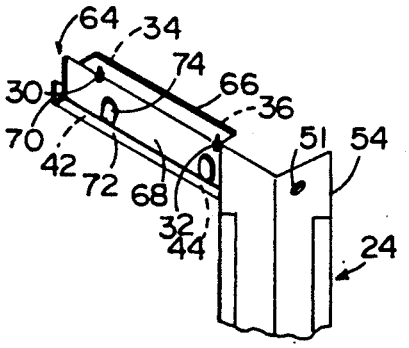
FIG. 3 is an enlarged perspective view of an upstanding post shown in FIG. 2.
Figure 3:
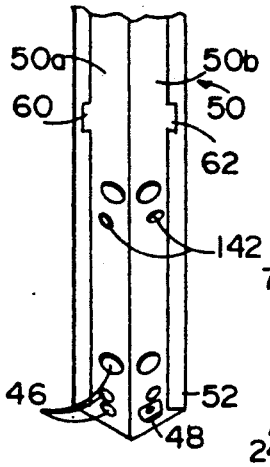

For purposes of description herein, the terms "upper," "lower," "right," "left," "rear," "front," "vertical," "horizontal," and derivatives thereof shall relate to the invention as oriented in FIG. 3, and with respect to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein, are not to be considered as limiting, unless the claims expressly state otherwise.

Figure 1:
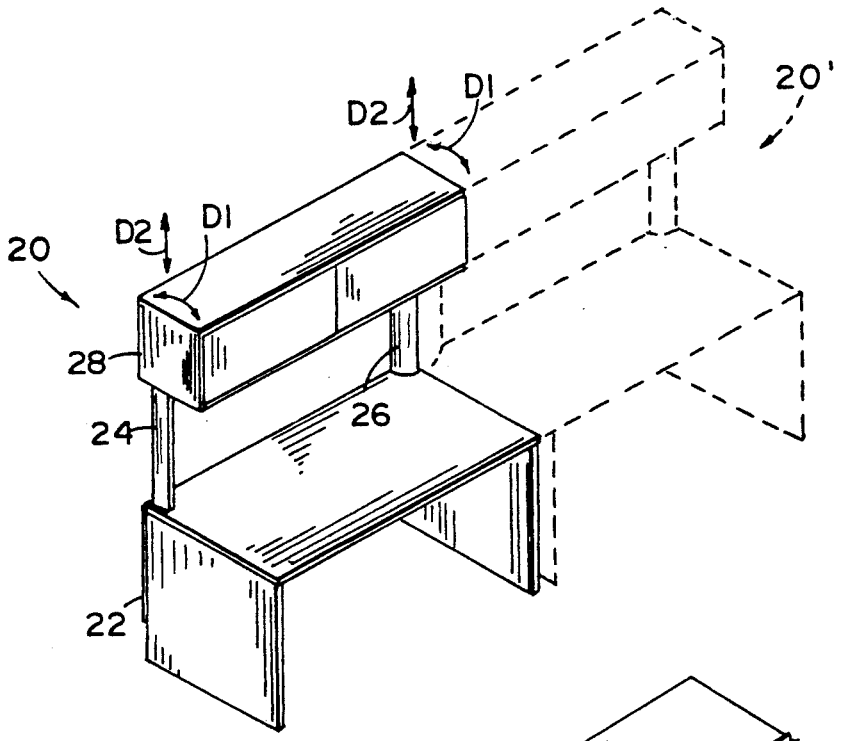
FIG. 1 is a perspective view of a modular furniture unit embodying the present invention, with a second furniture unit shown in phantom adjacent the first furniture unit.
Figure 2:
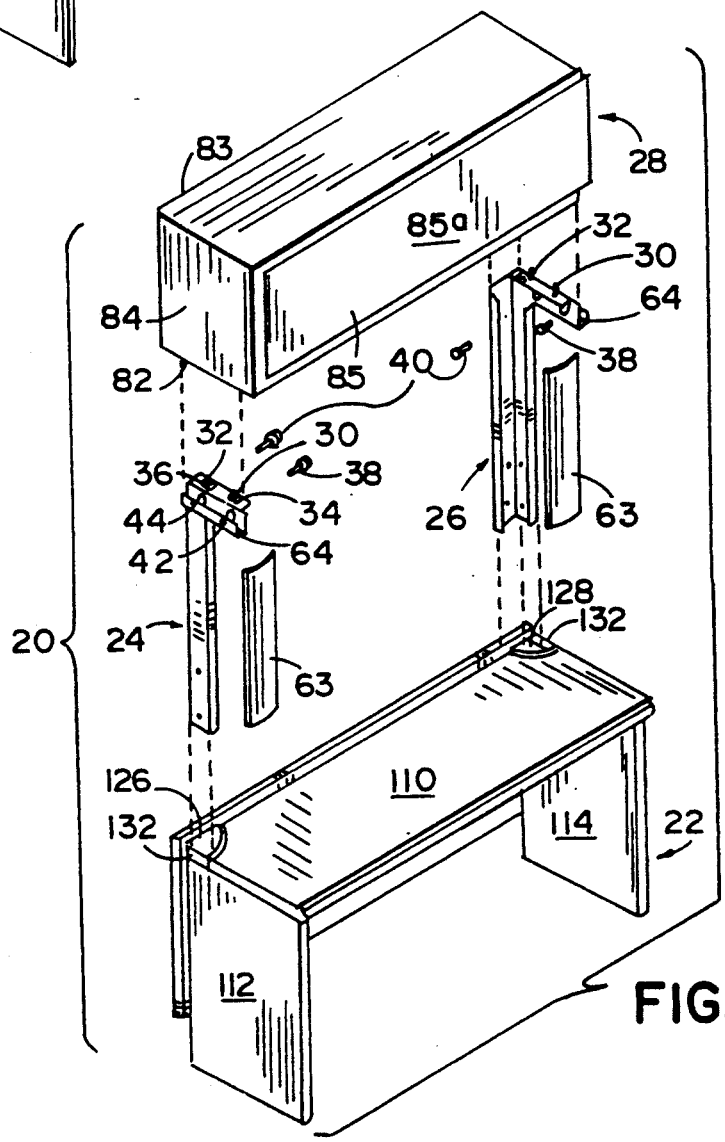
FIG. 2 is a partially exploded perspective view of the modular furniture unit in FIG. 1.
Figure 4:
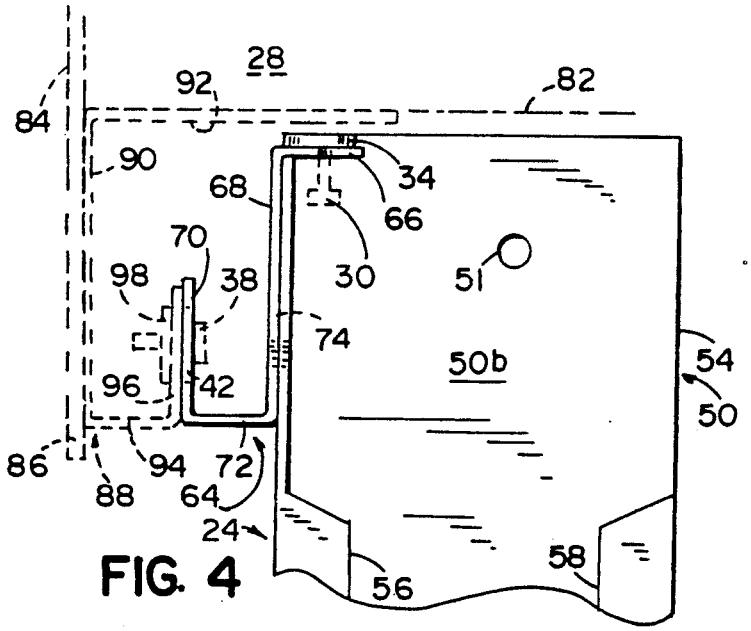
FIG. 4 is an enlarged front view of the upper end of the post in FIG. 3 with the overhead modular unit shown in phantom.
Figure 5:
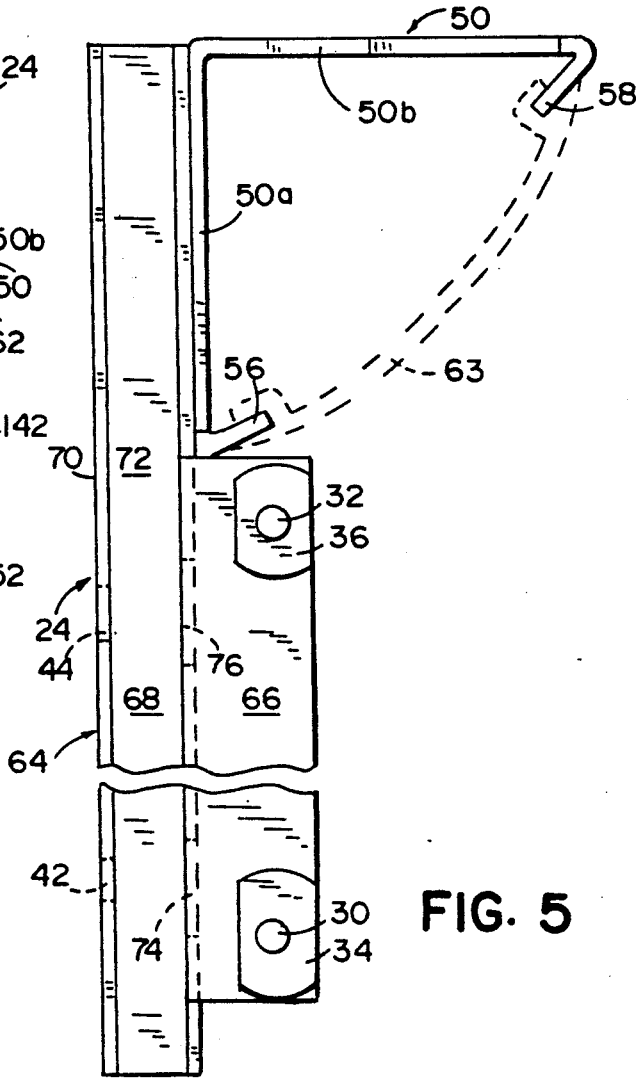
FIG. 5 is a partial enlarged fragmentary top view of the post in FIG. 3 with the post cover shown in phantom.

A modular furniture arrangement embodying the present invention is shown in FIGS. 1 and 2 and generally referred to as number 20. Modular furniture arrangement 20 includes a freestanding base unit 22, a pair of elongate upstanding posts 24 and 26 connected to base unit 22 and extending generally vertically upwardly therefrom, and an overhead modular unit 28 connected to the upper ends of posts 24 and 26. A pair of spaced leveling or adjustment screws 30 and 32 extend upwardly through leveling nuts 34 and 36 (FIGS. 3–5) attached to the upper ends of posts 24 and 26, screws 30 and 32 extending abuttingly against the underside of overhead modular unit 28 so that by axially manipulating screws 30 and 32, overhead modular unit 28 can be both horizontally leveled and vertically aligned with respect to adjacent overhead modular units 20'. The system of leveling permits a single operator to place an overhead modular unit 28 on posts 24 and 26, level and align same, and then secure same in place by use of attachment screws 38 and 40 which extend through attachment apertures 42 and 44 in posts 24 and 26 into nuts in overhead modular unit 28. Posts 24 and 26 are particularly adapted for use in a modular furniture arrangement such as is disclosed in U.S. Pat. No. 5,092,253 to Grund issued Mar. 3, 1992 entitled MODULAR FURNITURE (Ser. No. 07/307,775, filed Feb. 7, 1989), the entire contents of which are hereby incorporated by reference.

Elongate posts 24 and 26 are substantially mirror images of each other, and hence only post 24 will be described hereinafter to reduce repetition. Post 24 (FIG. 3) includes a vertical leg 50 with a lower end 52 and an upper end 54. Leg 50 has sides 50A and 50B forming a "V" sectional shape, and includes side flanges 56 and 58 extending inwardly respectively from sides 50A and 50B with notches 60 and 62 therein. An arcuately shaped cover 63 (FIGS. 2 and 5) is shaped to engage flanges 56 and 58 and provide an aesthetic appearance along the length of leg 50. Lower end 52 (FIG. 3) further includes attachment apertures 46 and may also include adjustment nuts 48 as required to attach lower end 52 to base unit 22 as discussed below.

It is contemplated that a number of different configurations of lower end 5 could be made to attach lower end 52 to base 22, though only one configuration is shown. Further, post 24 and 26 can be adapted to include various features, such as a hole 51 in upper end 54 which is adapted to receive a clip (not shown) such as for routing wires along the inside of post 24 between the channel formed by sides 50A and 50B and cover 63.

Figure 10:
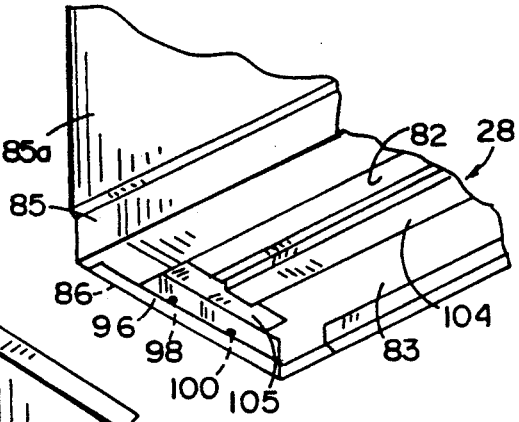
FIG. 10 is a bottom fragmentary perspective view of the overhead modular unit shown in FIG. 2.

A laterally extending bracket or adjustment bracket 64 (FIGS. 3–5) is spot-welded or otherwise secured to upper end 54 to side 50A of post 24. Bracket 64 includes a horizontal wall 66 and a "U" shaped portion including inner and outer vertical walls 68 and 70, respectively, joined by web 72. Horizontal wall 66 is positioned at the upper edge of upper end 54. Two leveling nuts 34 and 36 are tack-welded to the upper surface of horizontal wall 66 over corresponding holes in horizontal wall 66, and leveling screws 30 and 32 are threaded vertically upwardly into and through nuts 34 and 36, with the free end of screws 30 and 32 extending above nuts 34 and 36 and horizontal wall 66. Inner wall 68 includes enlarged apertures 74 and 76 providing access to attachment apertures 42 and 44 in outer wall 70. Attachment screws 38 and 40 (FIG. 12) can be placed through enlarged access apertures 74 and 76 into apertures 42 and 44 and into nuts 98 and 100 (FIGS. 4 and 10) located on overhead modular unit 28.

Overhead modular unit 28 (FIG. 2) includes a bottom panel 82, rear panel 83, opposing end panels 84, and front panel 85 including hinged door 85A. The lower edge of end panels 84 form aesthetic flanges 86 (FIG. 4) that extend downwardly from ends 84 a sufficient distance below bottom panel 82 to substantially hide or cover laterally extending bracket 64. An inner reinforcement 88 includes a vertical wall 90 and a horizontal wall 92 that are shaped to mateably nest against the inner corner formed by flange 86 and bottom panel 82, respectively, whereat inner reinforcement 88 is securely attached such as by spot-welding. Inner reinforcement 88 further includes an inwardly extending flange 94 connected to the lower edge of vertical wall 90, and an upstanding flange 96 that extends upwardly from the edge of flange 94. Holes are provided in upstanding flange 96, and attachment nuts 98 and 100 are tack-welded over the holes on the inside of flange 9 facing vertical wall 90. Enlarged access apertures 74 and 76 and attachment apertures 42 and 44 in brackets 64 align with the threaded holes in nuts 98 and 100, but apertures 42 and 44 provide enough clearance for the shaft of attachment screws 38 and 40 so that overhead modular unit 28 can be vertically and horizontally adjusted before tightening screws 38 and 40 into nuts 98 and 100. A lower hat-shaped brace 104 (FIG. 10) is attached to bottom panel 82, and forms a pocket 105 with end flange 86 between front panel 85 and rear panel 83 for receiving laterally extending bracket 64.

Posts 24 and 26 (FIG. 3) each include a lower end 52 adapted to engage the inside corner of a freestanding desk or other like furniture, although it is contemplated that end 52 could also be adapted for joining to the outside corner of a desk as well. In the embodiment shown, a modular furniture base unit 22 is illustrated wherein posts 24 and 26 fit into the inside corner of the supporting structure of base unit 22. A detailed description of several base units which could be used for base unit 22 can be found in U.S. Pat. No. 5,092,253 to Grund issued Mar. 3, 1992 entitled MODULAR FURNITURE (Ser. No. 07/307,775, filed Feb. 7, 1989). Only the necessary parts of base unit 22 are described hereinafter.

Base unit 22 (FIG. 6) includes a worksurface panel 110 supported by supports 112 and 114. Supports 112 and 114 are interconnected to form a rigid arrangement by back panel 116, which also engages the rear of worksurface panel 110. The rear corners 118 and 120 of worksurface panel 110 are cutaway to form quarter circles defined by arcuate marginal corner edges 122 and 124. The openings 126 and 128 thereby formed (FIG. 2) at rear corner 118 and 120 are normally covered by caps 130 and 132, but are shaped to telescopingly receive lower ends 52 of posts 24 and 26 when caps 130 are removed. Bracket 132A attaches to the top of supports 112 and 114, and secures cap 132 in place adjacent the outer edge of openings 126 and 128. Braces 134, brackets 135 and 136 are attached as needed to interconnect support 112 (and 114) to back panel 116 and to worksurface panel 110 at the inside corners formed therebetween. A cover 139 with hinge 139A is attachable to brace 134 to provide an aesthetic cover for brace 134 and to provide a channel for managing cables routed therethrough.

Though only one overhead modular unit 28 is shown, a number of different units can utilize this leveling and attaching arrangement. For example, it is contemplated that the above leveling and attaching arrangement are useful for overhead bookshelves, cabinets, lockers, or the like.

OPERATION

Figure 6:
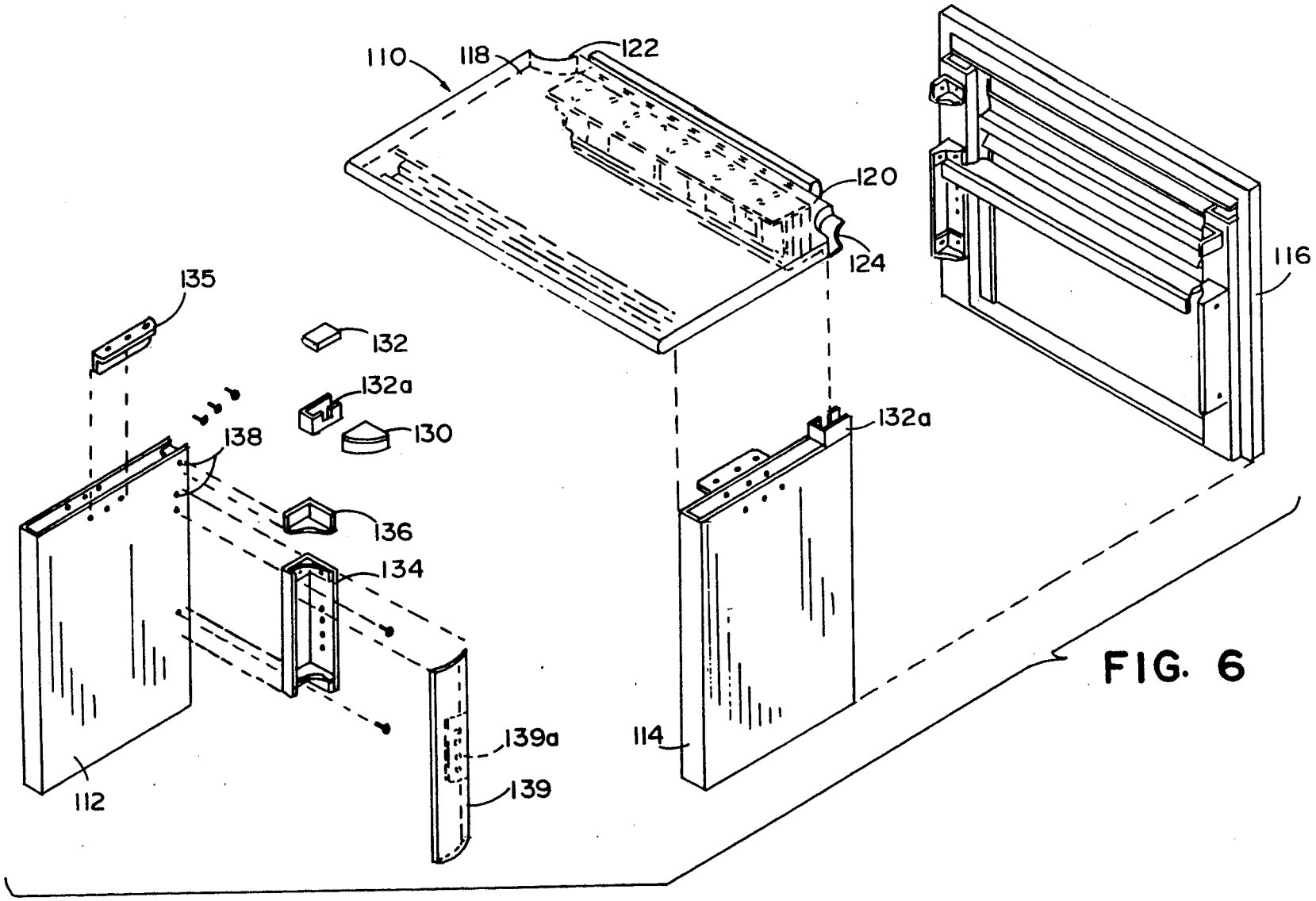
FIG. 6 is an exploded perspective view of the base unit shown in FIG. 2.
Figure 7:
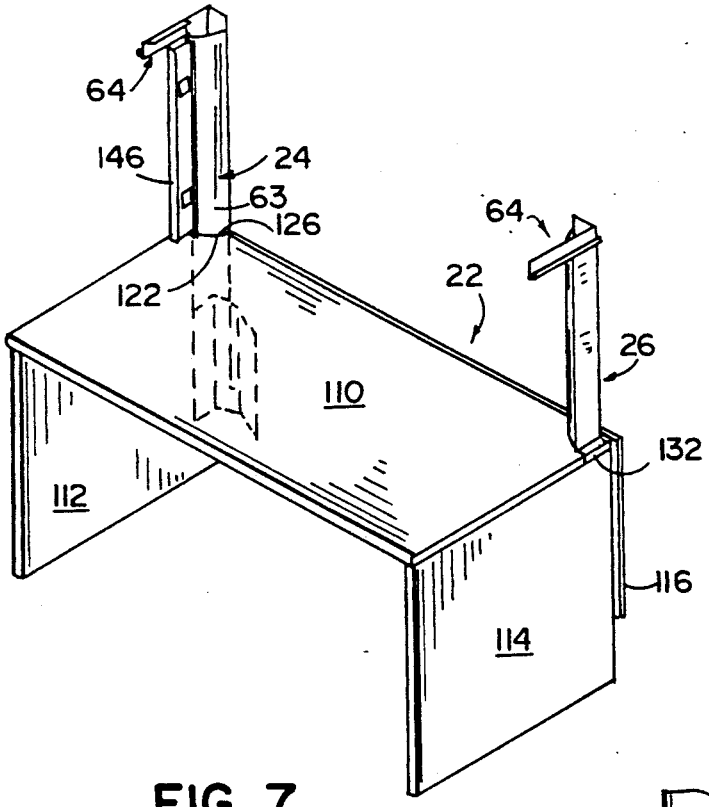
FIG. 7 is a perspective view of a pair of upstanding posts assembled to the base unit.
Figure 9:
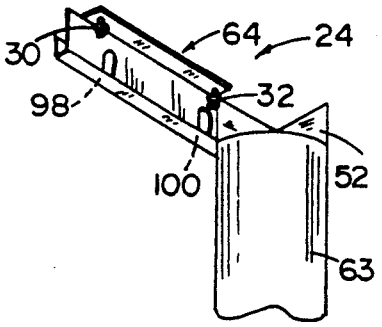
FIG. 9 is an enlarged bottom fragmentary perspective view of the circled portion in FIG. 7.
Figure 8:
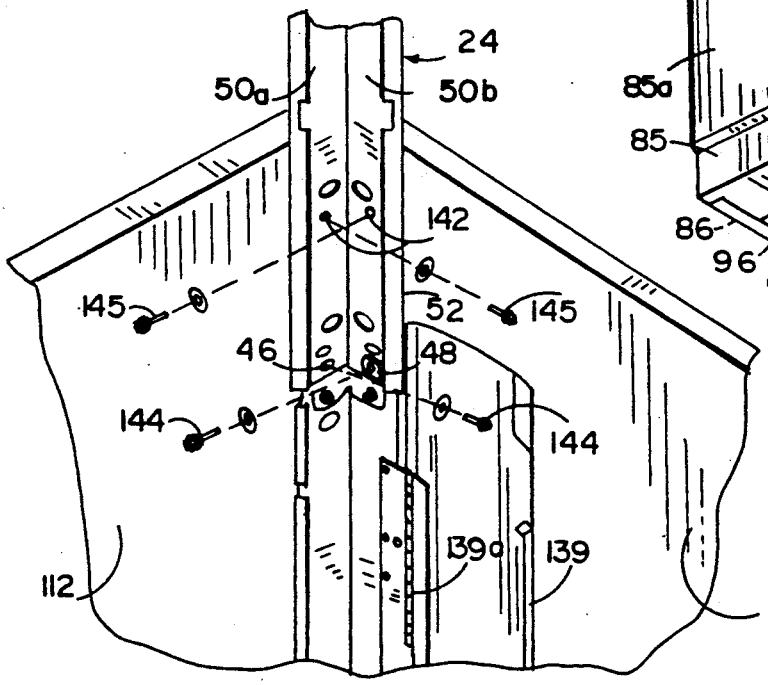
FIG. 8 is an enlarged fragmentary perspective view illustrating the attachment of the posts to the base unit, the base unit being shown with the worksurface panel removed.

Having described the preferred embodiment, the operation of this invention will become obvious to one skilled in the art. Assembly of the modular furniture arrangement 20 begins with an assembled base unit 22 (FIGS. 2 and 6). Cap 130 is removed exposing opening 126, and gusset 136 is removed if necessary. Cover 63 is joined to post 24, and post 24 is inserted into opening 126 (FIGS. 7–8). As installed, the "V" shaped section of post 24 nests against support 112 and back panel 116, and cover 63 rests against arcuate marginal edge 122 of worksurface panel 110 (FIG. 7). Post 26 is similarly placed into opening 128. Attachment apertures 46 on lower end 52 are aligned with mating holes 138 in supports 112 and 114 and back panel 116, and screws 144 are secured loosely therein (FIG. 8). In FIG. 8, worksurface panel 110 is removed to simplify the drawing. Screws 145 are also loosely inserted into holes 142 in post 24 and into support 112 and back panel 116 respectively. Post 26 is similarly installed. If adjusting nuts 48 are used, a carpenter's level 146 or other squaring device is placed against posts 24 and 26 to assure that posts 24 and 26 are vertically squarely positioned. A screw 144 is threaded into leveling nut 48 on side 50B and rotated with the free end of the screw engaging back panel 116 to force leg side 50B away from back panel 116 thus causing upper end 54 of post leg 50 to rotate rearwardly to a leveled condition. The remaining screws 144 and 145 are then tightened to secure posts 24 and 26 in the leveled condition. As installed, laterally extending brackets 64 extend over worksurface panel 110 in a position to support overhead modular unit 28 in cantilever fashion.

Figure 12:
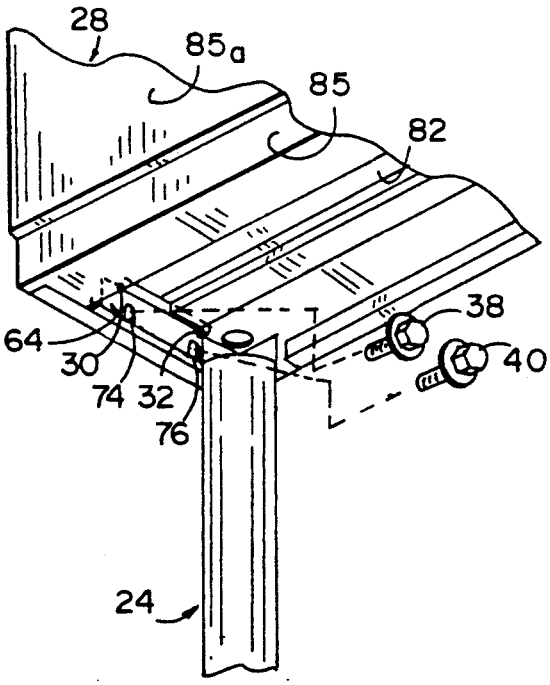
FIG. 12 is a bottom fragmentary perspective view showing the assembly of the overhead base unit to the post.
Figure 11:
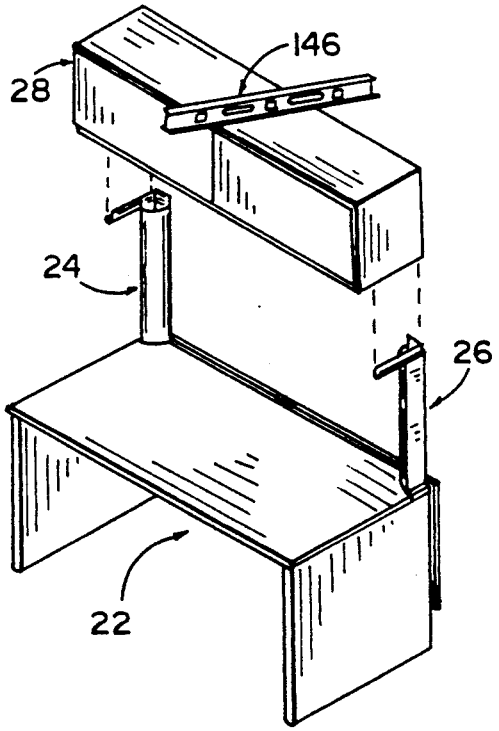
FIG. 11 is a perspective view illustrating the assembly of the overhead unit to a subassembly of the posts and base unit.
Figure 13:
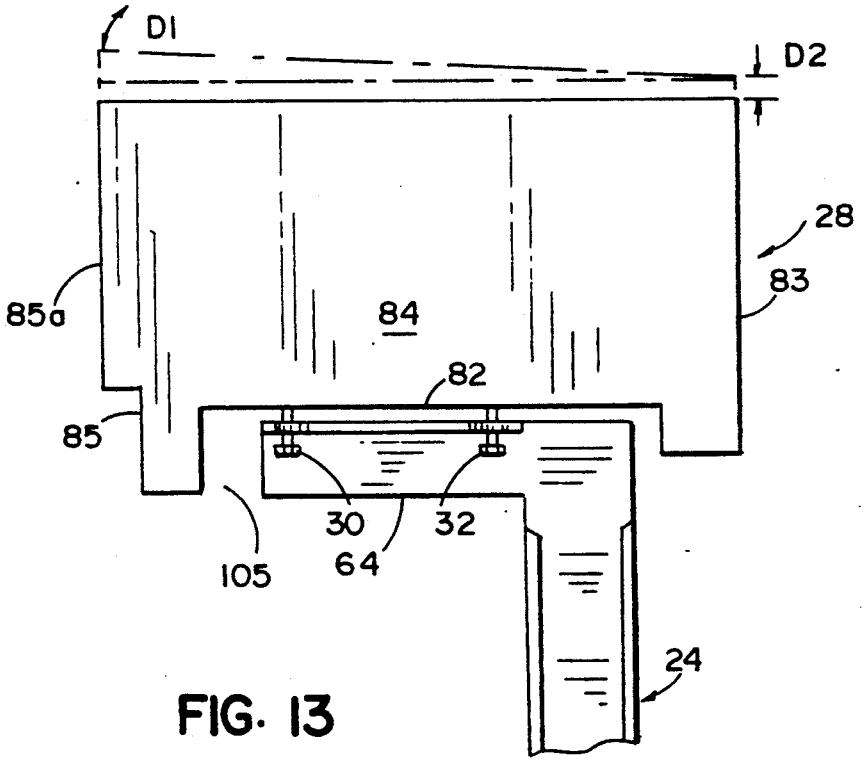
FIG. 13 is a side schematic view illustrating the adjustment of the leveling screws on the upper end of the post.

Overhead modular unit 28 (FIGS. 10–12) is then placed on the upper ends 54 of posts 24 and 26, with laterally extending brackets 64 fitting mateably into pockets 105 on the underside or lower portion of each end of overhead modular unit 28 (FIG. 12). As bracket 64 is inserted therein, holes 42 and 44 align with nuts 98 and 100 (FIGS. 4 and 12) such that attachment screws 38 and 40 can be loosely placed therein. This secures overhead modular unit 28 temporarily in place on posts 24 and 26, with overhead modular unit 28 being supported by the free ends of screws 30 and 32 which abut the bottom of overhead module unit 28. By adjusting or axially manipulating leveling screws 30 and 32 different amounts, overhead modular unit 28 can be tipped forward or rearward (represented by "D1" in FIGS. 1 and 13), or sideways to level same horizontally. Further, by adjusting all of screws 30 and 32 in a given direction, unit 28 can be raised or lowered (represented by "D2") to align with adjacent overhead modular units. Due to the size of apertures 42 and 44 (FIGS. 4–5), attachment screws 38 and 40 do not interfere with this adjustment for a given range of adjustment. Once overhead modular unit 28 is properly adjusted, attachment screws 38 and 40 are tightened to securely hold overhead modular unit 28 to posts 24 and 26, and in turn to base unit 22.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A modular furniture unit, comprising:

a base unit;

at least one elongate upstanding post including a lower end engaging said base unit so that said post extends generally vertically, and further including an upper end having a laterally extending bracket, said laterally extending bracket having a forward portion and a rearward portion;

an overhead modular unit including a lower portion engaging said laterally extending bracket;

means spaced from said at least one upstanding post for supporting said overhead modular unit along with said at least one upstanding post;

leveling means located on said laterally extending bracket for adjusting the spacial orientation of said overhead modular unit relative to said base unit, said leveling means including separately adjustable first and second lift devices, said first device located on said forward portion and said second device located on said rearward portion for adjustably supporting said overhead modular unit, whereby said modular unit can be adjusted without manually lifting the overhead modular unit; and attaching means for securely attaching said overhead modular unit to said at least one elongate upstanding post, whereby said overhead modular unit can be placed on said upstanding post, leveled, and secured to same without manipulating said upstanding post on the modular furniture unit, and whereby said overhead modular unit can be readily leveled by an installer without manually lifting and bearing the weight of the overhead unit.

2. A modular furniture unit as set forth in claim 1 including at least two of said posts.

3. A modular furniture unit as set forth in claim 2 wherein said leveling means includes a pair of leveling screws threadedly mounted in said laterally extending bracket in a generally vertical orientation, and being spaced apart, said leveling screws including free upper ends protruding through said laterally extending bracket and abuttingly supporting at least a portion of said overhead modular unit.

4. A modular furniture unit as set forth in claim 3 wherein said attaching means includes a pair of attachment screws extending through said laterally extending bracket into engagement with said overhead modular unit to securely interconnect same.

5. A modular furniture unit as set forth in claim 1 including two of said posts.

6. A modular furniture unit, comprising:

a base unit;

at least one elongate upstanding post including a lower end engaging said base unit so that said post extends generally vertically and further including an upper end having a laterally extending bracket;

an overhead modular unit including a lower portion engaging said at least one laterally extending bracket;

leveling means located on said laterally extending bracket for adjusting for spacial orientation of said overhead modular unit so that said overhead modular unit is generally level relative to a horizontal plane, said leveling means including a pair of leveling screws threadedly mounted in said laterally extending bracket in a generally vertical orientation, and being spaced apart, said leveling screws including free upper ends protruding through said laterally extending bracket and abuttingly supporting at least a portion of said overhead modular unit; and attachment means for securely attaching said overhead modular unit to said at least one elongate upstanding post, whereby said overhead modular unit can be placed on said upstanding post, leveled, and secured to same without manipulating said upstanding post on the modular furniture unit.

7. A modular furniture unit as set forth in claim 6 wherein said base unit includes a worksurface panel with a rear portion, and said post attaches to said rear portion with said laterally extending bracket overhanging said worksurface panel.

8. A modular furniture system for leveling and securing an overhead unit to a modular furniture base unit, comprising:

a pair of elongate posts each including a lower end adapted to securely engage the base unit, and further including an upper and including a laterally extending bracket with a vertical wall and a horizontal wall, said horizontal wall adapted to be positioned below and support the overhead unit, said horizontal wall including a forward portion and a rearward portion; and leveling means located on said horizontal wall for adjusting the spacial position of the overhead unit relative to said upper end so that the overhead unit can be positioned in a leveled condition in-line with adjacent overhead units, said leveling means including separately adjustable first and second lift devices, said first device located on said forward portion and said second device located on said rearward portion of said horizontal wall for adjusting the position of said overhead unit, whereby said modular unit can be adjusted to the leveled condition without manually lifting and supporting the overhead modular unit in the leveled condition, said vertical wall including one or more apertures receiving attachment screw elements to secure the overhead unit to said laterally extending bracket in the leveled condition.

9. A modular furniture system for leveling and securing an overhead unit to a modular furniture base unit, comprising:

a pair of elongate posts each including a lower end adapted to securely engage the base unit, and further including an upper end including a laterally extending bracket with a vertical wall and a horizontal wall, said horizontal wall adapted to be positioned below and support the overhead unit; and leveling means located on said horizontal wall for horizontally leveling and vertically adjusting the overhead unit relative to said upper end thus allowing the overhead unit to be both horizontally leveled and vertically adjusted to be in-line with adjacent overhead units, said vertical wall including one or more apertures receiving attachment screw elements to secure the overhead units to said laterally extending bracket in the leveled condition, said leveling means including a pair of leveling screws threadedly mounted in said laterally extending bracket in a generally vertical orientation and being spaced apart, said leveling screws including free upper ends protruding through said laterally extending bracket and abuttingly supporting at least a portion of said overhead modular unit.

10. A modular furniture system as set forth in claim 9 wherein the base unit includes a worksurface panel with a rear portion, and said post is adapted to attach to the rear portion with said laterally extending bracket overhanging the worksurface panel.

11. A modular furniture arrangement, comprising:

at least one worksurface panel;

at least one back panel;

at least two supports connected with said worksurface panel and said back panel to form a modular, freestanding furniture unit supported by said supports on a floor surface;

at least one overhead unit;

at least two rigid posts having lower ends adapted for connection with at least one of said supports and with said back panel and upper ends adapted for connection with said overhead unit, said upper ends each including a forward portion and a rearward portion;

at least two mounting apertures disposed through said worksurface panel adjacent opposite rear corners thereof; each of said mounting apertures being shaped to receive an associated one of said post lower ends therethrough;

means for detachably and rigidly connecting the lower ends of said posts with said at least one of said supports and with said back panel in a manner such that said posts extend upwardly from said furniture unit in a generally vertical orientation;

means for rigidly connecting the upper ends of said posts with said overhead unit; and means located on the upper ends of said two rigid posts for leveling said overhead unit, said means for leveling including separately adjustable first and second lift devices, said first device located on said forward portions and said second device located on said rearward portion for adjusting the position of said overhead modular unit relative to said upper ends of said posts, whereby to mount said overhead unit on said furniture unit, said posts are inserted through said mounting apertures, the lower ends of said posts are securely fastened to said at least one of said supports and to said back panel, said overhead unit is leveled on the upper ends of said posts, and the upper ends of said posts are securely fastened to said overhead unit.

12. A modular furniture arrangement as set forth in claim 11 wherein said upper ends of said posts each include laterally extending brackets and wherein said lift devices are a pair of leveling screws threadedly mounted in said laterally extend bracket in a generally vertical orientation, and being spaced apart, said leveling screws including free upper ends protruding through said laterally extending bracket and abuttingly supporting at least a portion of said overhead modular unit.

13. A modular furniture arrangement, comprising:

at least one worksurface panel;

at least one back panel;

at least two supports connected with said worksurface panel and said back panel to form a modular, freestanding furniture unit supported by said supports on a floor surface;

at least one overhead unit;

at least two rigid posts, having lower ends for connection with at least one of said supports and said back panel, and upper ends for connection with said overhead unit;

at least two mounting apertures disposed through said worksurface panel adjacent opposite rear corners thereof; each of said mounting apertures being shaped to receive an associated one of said posts therethrough;

means for detachably and rigidly connecting the lower ends of said posts with said one said supports and said back panel in a manner such that said posts extend upwardly from said furniture unit in a generally vertical orientation;

means for rigidly connecting the upper ends of said posts with said overhead unit; and means located on the upper ends of said two rigid posts for leveling said overhead unit;

wherein said upper ends of said posts each include laterally extending brackets and said leveling means includes a pair of leveling screws threadedly mounted in said laterally extending bracket in a generally vertical orientation, and said leveling screws being spaced apart, said leveling screws including free upper ends protruding through said laterally extending bracket and abuttingly supporting at least a portion of said overhead modular unit; and said means for rigidly connecting including a pair of attachment screws extending through said laterally extending bracket into engagement with said overhead modular unit to securely interconnect said bracket and said modular unit.

14. A modular furniture unit as set forth in claim 13 wherein said upper ends of said at least two rigid posts each include a horizontal wall positioned below said overhead unit which includes said means for leveling, and said two rigid posts further each include a vertical wall including means for securely attaching said overhead unit to said two rigid posts.

15. In a furniture arrangement of the type having at least one freestanding furniture unit, and at least one overhead unit, the improvement of an overhead support and leveling system therefor, comprising:

at least one rigid support post shaped to support said overhead unit directly over said furniture unit at a selected vertical height and at a selected horizontal angle; said support post having a lower end thereof with means for securely mounting said support post on said furniture unit such that said support post extends upwardly therefrom in a generally vertical orientation, said support post also having an upper end with an adjustment bracket shaped to support said overhead unit in a generally horizontal orientation;

first and second adjustment screws threadedly mounted in said adjustment bracket in a generally vertical orientation, said first and second adjustment screws being spaced apart, said adjustment screws each having free upper ends protruding through said adjustment bracket and abuttingly supporting at least a portion of said overhead unit, whereby axial manipulation of said adjustment screws varies both the horizontal angle and the vertical height of said overhead unit with respect to said furniture unit to permit accurate alignment with adjacent overhead units.

* * * * *

UNITED STATES PATENT AND TRADEMARK OFFICE

CERTIFICATE OF CORRECTION

PATENT NO. : 5,183,319

DATED : February 2, 1993

INVENTOR(S) : Alan L. Pearson et al.

It is certified that error appears in the above-identified patent and that said Letters Patent is hereby corrected as shown below:

Column 3, line 21;
"lower end 5" should be --lower end 52--.

Column 8, claim 13, line 54;
After "one" insert --of--.

Signed and Sealed this

First Day of February, 1994

Bruce Lehman

*Attest:*

BRUCE LEHMAN

*Attesting Officer*

*Commissioner of Patents and Trademarks*